US005209349A

United States Patent [19]

Porter et al.

[11] Patent Number: 5,209,349

[45] Date of Patent: May 11, 1993

[54] DEVICE AND METHOD FOR DISTRIBUTION OF CONSUMER SAMPLES WITH PUBLICATIONS

[75] Inventors: William J. N. Porter; James R. Benjamin, Woodland Hills, both of Calif.; Richard M. Applebaum, 1106 Loma Dr., Hermosa Beach, Calif. 90245

[73] Assignee: Richard M. Applebaum, Redondo Beach, Calif.

[21] Appl. No.: 564,366

[22] Filed: Aug. 7, 1990

[51] Int. Cl.[5] ..... B65D 71/08; A45F 5/12

[52] U.S. Cl. ..... 206/232; 53/445; 53/449; 53/472; 53/474; 206/45.33; 206/424; 206/486; 206/497; 206/523

[58] Field of Search ..... 206/45.31, 45.33, 232, 206/223, 216, 424, 472, 475, 486, 489, 497, 523; 229/9; 281/15.1; 283/56; 53/474, 449, 445, 472

[56] References Cited

U.S. PATENT DOCUMENTS

| | | | |
|---|---|---|---|
| Re. 33,503 | 12/1990 | Schluger | 206/232 X |
| 1,633,444 | 6/1927 | Fruitena | 206/489 X |
| 1,689,637 | 10/1928 | Mordecai | 281/15.1 |
| 1,787,569 | 1/1931 | Deutshmeister | 206/232 X |
| 2,025,352 | 12/1935 | Lemon | 206/232 |
| 2,061,139 | 11/1936 | Cohen | 206/489 |
| 2,239,145 | 4/1941 | Doner | 281/15.1 |
| 2,314,721 | 3/1943 | Lowenstein | 229/9 |
| 2,652,149 | 9/1953 | O'Meara | 206/232 |
| 2,728,450 | 12/1955 | Haire | 206/424 X |
| 3,212,638 | 10/1965 | Tomlinson | 206/489 |
| 3,275,316 | 9/1966 | Cleary, Jr. | 283/56 X |
| 3,442,372 | 5/1969 | Carmichael et al. | 206/424 X |
| 3,483,965 | 12/1969 | Rosenblatt | 206/424 |
| 3,512,332 | 5/1970 | Klein | 53/449 |
| 3,583,729 | 6/1971 | DeGroot | 206/232 X |
| 3,799,332 | 3/1974 | Jeronimus | 206/44 R |
| 4,105,116 | 8/1978 | Jones et al. . | |
| 4,369,882 | 1/1983 | Schluger . | |
| 4,492,306 | 1/1985 | Cooper et al. | 206/216 |
| 4,524,867 | 6/1985 | Klein et al. | 206/232 |
| 4,620,630 | 11/1986 | Moss | 206/45.33 X |
| 4,706,996 | 11/1987 | Fasham . | |
| 4,711,348 | 12/1987 | Schluger . | |
| 4,712,673 | 12/1987 | Moore . | |
| 4,807,806 | 2/1989 | Neiman . | |

*Primary Examiner*—Bryon P. Gehman

*Attorney, Agent, or Firm*—Knobbe Martens Olson & Bear

[57] ABSTRACT

An apparatus and method for distributing product samples to consumers along with a publication is disclosed in which a container is provided with cut-out recesses having a shape conforming to that of the samples. The samples are visibly retained within the recesses by a shrinkwrap covering surrounding the container. The container is then packaged with the publication within the protective shrinkwrap covering of the publication. The sample container is constructed from a compressible material that absorbs shocks and forces exerted on the container, thereby protecting the samples from damage.

10 Claims, 2 Drawing Sheets

FIG. 1
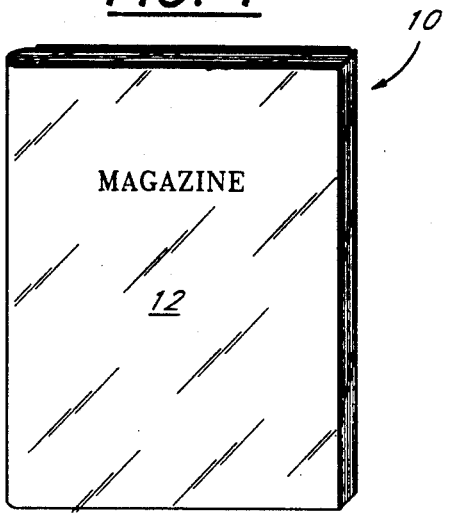
FIG. 2
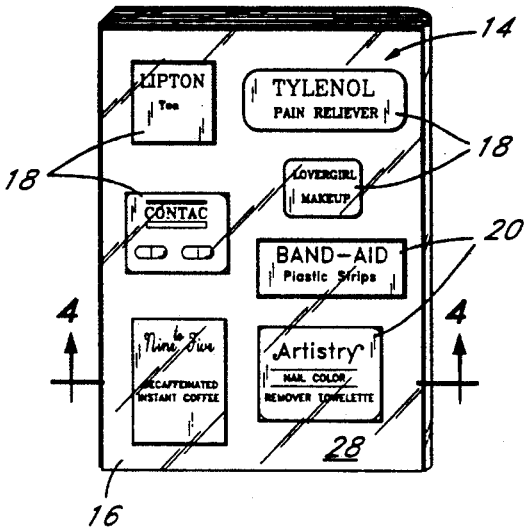
FIG. 3
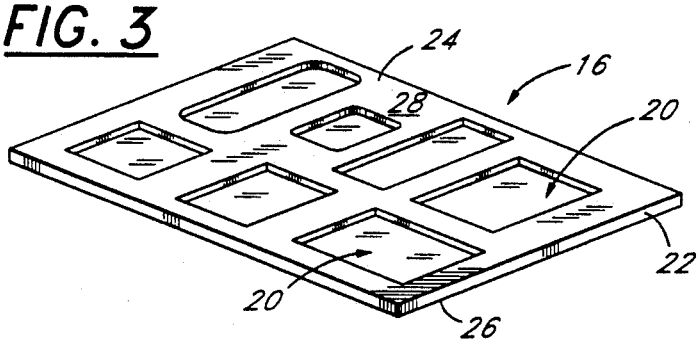
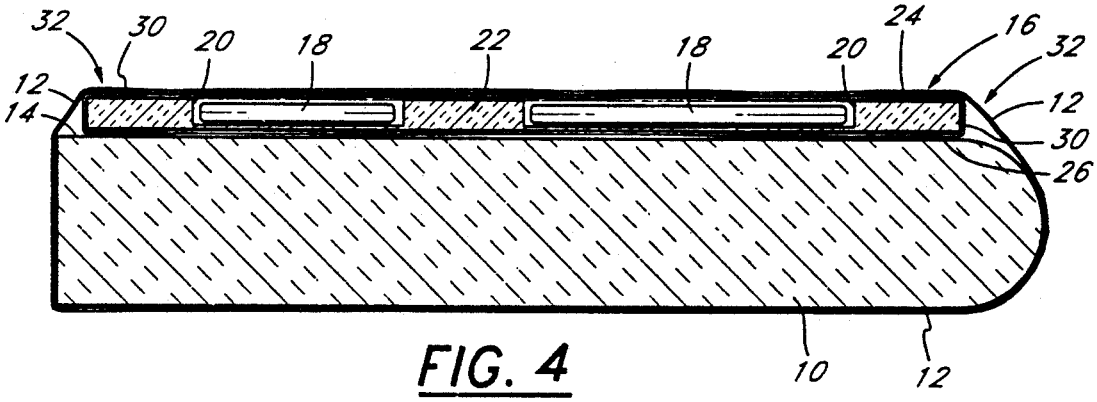
FIG. 4

DEVICE AND METHOD FOR DISTRIBUTION OF CONSUMER SAMPLES WITH PUBLICATIONS

BACKGROUND OF INVENTION

The present invention relates to a device and method for publishing and packaging consumer product samples for distribution with publications, such as magazines, newspapers, and other forms of media.

For the purpose of advertising various commodities, it has been the practice to distribute product samples through the mail and other channels usually employed for the purpose. As will be readily recognized, the placing of the product sample in the hands of the potential consumer of such product is a powerful tool for marketing that product. Therefore, there is always a need for efficient distribution of consumer product samples; that is, distribution of samples to those consumers who are most likely to actually use the sample and then purchase normal size containers of the product through local retail outlets.

In the past, such consumer product samples were typically distributed by direct-mail techniques, door to door delivery, street corner give-away and store sampling, which, in the last few years, have become very expensive. By utilizing demographic distribution information, manufacturers of products could target specific areas of a geographic locale for their distribution of product samples. However, even this method had a large degree of inefficiency since, as will be readily recognized, many persons living within a particular geographic locale are not potential consumers for all types of products.

Distribution with magazines or other publications would be more effective than direct mail or other distribution methods because the subject matter of the publication can be used to ascertain the interest of the consumer. For example, a magazine directed to cooking or gardening is a much more direct and efficient means of distribution of product samples relating to those topics because the readers of such magazines presumably are already potential consumers for such products. In this context, samples and advertising literature (such as coupons, etc.) are usually loosely inserted in the publication. However, one serious drawback in connection with magazine sampling is the limitation on sample size and configuration. For example, such samples would have to be virtually 2-dimensional in order to lie flat within a magazine. This is a serious limitation since 3-dimensional sample products, up to now, cannot be safely and efficiently distributed with magazines. Furthermore, such samples and accompanying literature often become separated from the magazine or destroyed before reaching the consumer. Another limitation on the distribution of samples through magazines is that the sample is, of necessity, hidden within the magazine as that is the only means for retaining the sample within the magazine. Thus, it often becomes separated from the magazine even prior to the time that the reader may see it. Thus, heretofore, the distribution of consumer product samples through magazines also have serious limitations such that direct mail continues to be the primary means of distribution of such samples, while the physical limitations of the publishing and distribution of magazines permits only the distribution of coupons to the consumer because of their 2-dimensional configuration.

Another method of distribution with magazines is disclosed by U.S. Pat. No. 4,492,306 which describes a transparent pouch, bound up as a magazine page for distributing dehydrated foods in plastic bags. U.S. Pat. No. 4,492,306 does not, however, provide adequate protection for all types of samples from, for example, external pressure. Pressure is often exerted to the magazines during stacking, shipping and newsstand display. Transparent pouches such as disclosed in U.S. Pat No. 4,492,306 are prone to tear or burst, releasing the sample products, which thus do not reach the consumer. Further, where the samples consist of products more fragile than dehydrated foods, such as pharmaceuticals, the transparent pouch does not provide sufficient protection. This is particularly true in light of the typical procedures for magazine and newspaper distribution. For example, after magazines and newspapers are stacked and bound in bundles a foot or more high, they are delivered to the local wholesale or other retail outlets or newsstands. In the course of delivery, the bundles are frequently thrown from the back of trucks, stacked two or more on top of one another and generally handled in a rough manner. Furthermore, weather conditions, such as extreme cold air or wind, also subject the product to severe environmental conditions.

Accordingly, there is a need to take advantage of the efficient distribution of consumer product samples offered by magazine and newspaper publishing and distribution without the existing limitations of 2-dimensional sample configuration and the adverse conditions under which magazines and newspapers are distributed.

SUMMARY OF THE INVENTION

The present invention provides a combined sample display and container which protects the samples and can easily be inserted into the transparent protective coating or shrinkwrap covering of a magazine or other publication being delivered to wholesalers, newsstands, and retailers for sale to consumers. While being prominently displayed to the consumer, the samples remain protected from the adverse conditions under which magazines are distributed by virtue of the protection afforded by the recess windows cut into the display container, thereby minimizing wasted expenditure by the manufacturer and its customer.

The present invention therefore overcomes the foregoing disadvantages of the prior art and provides a container which is lightweight, inexpensive, as well as being efficient for display purposes and advertising purposes. More specifically, the present invention relates to an advertising and display device or carrier in the form of a lightweight container comprising a body having a core comprised of a thin sheet of foamcore or corrugated board, cardboard, or other similar lightweight material, and a top and bottom covering. The bottom covering or backing is relatively less compressible than the core to provide rigidity to the container. The container is provided with window recesses arranged in a manner to make efficient use of the available space in the thin material. The window recesses or die cut areas are provided for positioning sample-sized products therein which are thus protected from external pressure. In the preferred embodiment of the invention, the samples are securely held by means of a transparent protective coating, such as a shrinkwrap covering around the container and the samples.

Advantageously, the resulting sealed container can then be inserted safely and conveniently into the shrinkwrap covering of magazines and other forms of published media for distribution to newsstands. As an important advantage of the present invention, the container is sized so as to be approximately the same size as the magazine or other publication with which it is distributed in order to reduce movement and vibration within the magazine's shrinkwrap cover. Furthermore, the size of the container allows it to distribute the weight and forces exerted on magazine stacks and bundles over the entire surface area of the container and to transmit such forces through the container to the publication so as to avoid damage to the consumer samples contained within the window cutouts of the container. That is, the material from which the container is constructed is not only light, but also absorbent in terms of the kinetic energy which may be exerted on the container and the published product. In addition, the container may be positioned on the back cover of a magazine so as to be clearly visible through the clear shrinkwrap cover thereof, providing additional visibility and impact for this form of consumer sample distribution. Alternatively, the container may be inserted within the publication. The interest of consumers in the particular product samples mailed can be ascertained by virtue of the subject content of the magazine or other form of published media.

In an alternative embodiment of the present invention, a thin sheet of foamcore, or other lightweight material is again provided with cut out window recesses to form the container, and consumer product samples are appropriately configured therein. A thin transparent plastic facing is then applied to the front side of the container and sealed thereto by glue or any other convenient adhesive. A sleeve or overwrap made from, for example, paperboard is subsequently placed around and enveloping the container and facing. The front side of the overwrap is provided with cut out windows which correspond to those cut out in the container, such that the consumer product samples within the container are visible therethrough. Other protective or insulative materials, such as air-filled plastic bubbles, may also be utilized.

Full details of the present invention are set forth in the following description and are illustrated in the accompanying drawings. Attention is called to the fact, however, that the drawings are illustrative only and that changes may be made in the specific construction illustrated and described within the scope of the appended claims.

BRIEF DESCRIPTION OF THE DRAWINGS

FIG. 1 is a perspective view of the cover of a magazine as it would be packaged in a shrinkwrap enclosure, ready for distribution;

FIG. 2 is a rear view of the magazines of FIG. 1 containing the present invention within the shrinkwrap cover of the magazine, illustrating on the back cover of the magazine the visibility of the product samples embedded in the present invention;

FIG. 3 is a perspective view of the preferred embodiment of the container of the present invention, illustrating the cut out window recesses in the container;

FIG. 4 is a cross-sectional view taken along line 4—4 of FIG. 2 illustrating the manner in which the present invention is positioned on the back cover of the magazine for shock absorption.

DETAILED DESCRIPTION OF THE INVENTION

Figure 5:
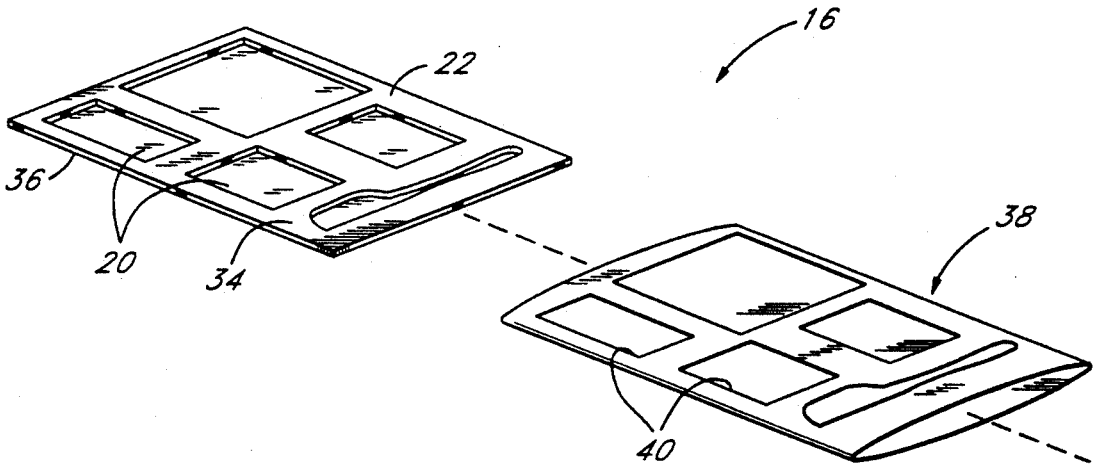
FIG. 5 is an exploded perspective view of an alternative embodiment of the present invention, illustrating the container with cut out window recesses for containing the product samples, the front side of the container being covered by a transparent plastic facing, and also illustrating a paper overwrap, with cut out windows, corresponding to the cut out recesses in the container, through which the product samples are visible.

Referring to FIG. 1, there is shown a typical magazine 10 having a lightweight plastic shrinkwrap covering 12 which is transparent so as to permit the cover of the magazine to be seen therethrough. It should be noted that more and more magazines are being packaged in this fashion in order to protect the appearance of the magazine during the distribution process. For example, if the magazine shown in FIG. 1 were intended for delivery to an individual subscriber, a simple mailing label would be applied thereto and the magazine would be delivered through the normal mail channels, with the shrinkwrap cover protecting the magazine from dirt and damage. In addition, if the magazine were intended for newsstand or retail sales, it might be stacked with numerous other magazines and tied in a bundle for delivery via truck, etc. Again, the magazine is protected by means of the shrinkwrap cover.

Referring to FIG. 2, there is shown the reverse or back cover 14 of the magazine 10 of FIG. 1. As shown therein, the consumer sample container 16 of the present invention is shown positioned on the back cover 14 of the magazine and contained within the plastic shrinkwrap cover 12 thereof. Again, clearly visible through the shrinkwrap cover are the consumer product samples 18 inserted within the window recesses 20 of the container. As illustrated, the shape of each recess 20 conforms closely to the shape of the sample 18 contained therein to prevent movement of the sample within the recess, thereby preventing damage to the sample and the shrinkwrap cover 12.

Although the container 16 of the present invention is shown in relationship to a magazine, as illustrated in FIGS. 1, 2 and 4, it should be pointed out that the principles of this invention apply equally well to other forms of publications that may be distributed in a clear or transparent covering, such as newspapers, books, audio and videotapes, and the like.

One of the important advantages of the present invention, which is illustrated in FIGS. 1 and 2, is that the container 16 has approximately the same 2-dimensional configuration as the back cover 14 of the magazine 10. This means that the container fits snugly within the shrinkwrapped cover 12 of the magazine so as to avoid movement, vibration, and possible rupture of the shrinkwrap cover. In this fashion, the product samples 18 contained within the container 16 are further protected from damage. In addition, the forces exerted on the magazine, due, for example, to stacking or dropping at delivery, are distributed over the entire surface of the container and the magazine. Accordingly, the force is not concentrated in one particular area such that one of the samples might be crushed. Furthermore, the container 16 does not present any sharp edges that might rupture the covering 12 or make stacking uneven.

Another important advantage of the present invention, which is illustrated in FIG. 2, is that the consumer samples 18 are clearly visible on the back cover 14 of the magazine 10. This positioning ensures that they will be immediately noticed by the consumer, so that the advertising impact of this sampling method is greatly enhanced. In addition, since the sample container 16 is simply removably placed adjacent the back cover 14 of the magazine, without being adhered thereto, the value and visibility of back cover advertising is not diminished. In assembling the magazine, as shown in FIG. 2, the sample container 16 is simply placed adjacent the back cover of the magazine prior to the final shrinkwrap step for the magazine. Alternatively, container 16 may be inserted within the magazine or newspaper. Thus, it is not necessary to go to the expense of additional manufacturing steps to adhere, staple, or otherwise attach the sample container 16 to the magazine itself.

Referring to FIG. 3, there is shown the preferred embodiment of the container 16 of the present invention, including the recesses 20. The inner core 22 of the sample container 16 is comprised of a thin sheet of lightweight foamcore, corrugated board or "cardboard," or other lightweight material. The core 22 is covered on both sides with an upper covering 24 and a bottom covering or backing 26, described in more detail below. The coverings are secured with glue or other convenient adhesive to the front and back surfaces of the core material. The upper surface 28 of the container 16 provides window recesses 20, which may be die cut, of approximately ¼" in depth, enabling the product samples 18 to be safely embedded in the container 16. The display device 16 is then covered with a transparent film, thereby holding the product samples 18 securely in place. This separate film or shrinkwrap cover for the container itself is shown and described below in connection with FIG. 4. The cut out recesses 20 in the core 22 can be arranged in any manner to achieve maximum efficiency in space and to evenly distribute shock or drop forces. For example, as shown in FIG. 3, the recesses 20 should be arranged as symmetrically as possible in the upper surface 28 of the container 16 and should be separated from one another by a strip of core material of not less than about one-half (½) to one (1) inch.

Referring to FIG. 4, there is shown a cross-sectional view of the sample container 16 taken through one of the cut-out window recesses 20 and illustrating the placement of the sample 18 within said recess 20. As shown in this view, the window 20 has a depth or thickness which is at least the same or greater than that of the sample itself. This provides the necessary protection for the sample during distribution and delivery of the magazine 10. It has been found that most samples are manufactured to be no greater than 3/16" in depth so as to be available for convenient direct-mail purposes. Thus, the container of the present invention is ¼" or more in thickness so that current sample manufacture techniques need not be modified in order to accommodate the principles of the present invention.

FIG. 4 illustrates a window 20 in which the depth thereof is less than the thickness of the core 22. In another embodiment, to facilitate manufacturing, the window may be cut completely through the core 22, the sample being initially retained solely by the backing 26. After the samples are placed in the recesses 20, they are securely retained in place by a transparent film or coating, such as a shrinkwrap covering 30, which permits the samples to remain visible to the consumer. This shrinkwrap cover 30 is shown in FIG. 4 just below the shrinkwrap cover 12 of the magazine, providing a double layer of protection for the sample, while still retaining it in place and providing for its visibility.

As is further illustrated in FIG. 4, the core 22 of the container 16 is such that it absorbs shocks and other forces to the container 16 without transmitting them to the samples 18. For example, it has been found that in typical magazine delivery procedures, as many as 4 to 6 bundles of magazines may be stacked one on top of another at one time. Given the acceleration of gravity, this calculates into a substantial force that may be exerted on any given sample container. A drop test conducted from three feet resulted in zero failure. Thus, the thickness of the container is such that this amount of force will be absorbed while still protecting the samples contained within the recesses.

In addition, as illustrated in FIG. 4, and as mentioned above, the container 16 of the present invention is configured in the 2-dimensional sense to have approximately the same dimensions as the back cover 14 of a magazine or other publication with which the consumer samples are being distributed. This means that there will be very little slack or looseness in the shrinkwrap cover 12 surrounding the container along the edges of the publication, as shown at 32 in FIG. 4. With less slack in the shrinkwrap cover 12, there is less of the cover 12 that may expand or contract with environmental conditions and less exposure to ripping or tearing. Furthermore, the container 16 will remain tightly bound within the shrinkwrap cover 12 of the publication, without sliding or moving relative thereto, thereby maintaining the integrity of the combination publication/sample container. Moreover, if desired, a traction material (not shown) can be applied to the bottom surface 26 of the container 16 to further inhibit its movement upon the back cover 14 of the publication 10. Such a traction device may take the form of certain type of rubberized material, etc.

One of the important advantages of the present invention is the backing 26 which is applied to the bottom surface of the core 22 of the container 16. As illustrated in FIG. 3, with the window recesses 20 cut out of the core 22 of the container, there is very little of the core remaining for structural or strength purposes. Accordingly, the backing 26 is relatively less compressible than the core 22, and is applied thereto to act as a stiffener to provide strength and rigidity to the container. It has also been found that the container, with the stiff backing 26 in place, also provides protection for the magazine or other publication. Furthermore, the backing 26 on the back of the container provides a means for containing samples 18 within the recessed windows 20 in the event that the windows are cut completely through the core material, which may be desirable for manufacturing efficiency. The container 16 is constructed so as to provide resistance to heat which it may experience as it is being processed by automatic high speed inserting equipment and in shrinkwrapping equipment.

FIG. 5 illustrates an alternative embodiment of the invention. The thin sheet of foamcore or other lightweight core 22 of the container 16 is again provided with window recesses 20. The front side 34 of the device is covered with a transparent material through which the product samples (not shown) will be visible. The product samples are then safely embedded in the recesses 20 by inserting them from the back side 36 of the device 16. The container bearing the product samples is then inserted into a paper sleeve or overwrap 38. This paper overwrap 38 is provided with cut out window openings 40 which correspond to the same size and layout of the cut out window recesses 20 in the container, and thus enable the product samples to be visible through the package. The back of the paper overwrap 38 has no cut out window openings, and therefore holds the product samples securely in place.

While the present invention has been described and illustrated in connection with specific embodiments, it is understood that various changes may be made in adapting and modifying the invention to different embodiments without departing from the broader inventive concepts disclosed herein and encompassed by the following claims.

What is claimed is:

1. A container for the distribution of a product sample to consumers along with a publication, wherein an outer transparent protective coating surrounding said publication and container is provided, said container comprising:

a body being substantially planar and having lateral edges defining the outer shape of said container and having a predetermined thickness, said body comprising:

an inner core comprising a compressible material for absorbing shocks and forces exerted on said container;

a bottom covering adhered to the bottom surface of said core comprising a backing;

an upper covering adhered to the upper surface of said core; and a recess in said core of said body and having an opening through said upper covering, said recess receiving and containing a product sample; and an inner transparent protective coating entirely surrounding and closely conforming to the shape of said body, whereby said product sample is securely and visibly retained within said recess, said container being snugly packaged together with said publication and within said outer transparent protective coating, said backing being adjacent said publication so that said product sample is visible through said inner transparent protective coating and through said outer transparent protective coating and said shape of said container conforming closely to the shape of said publication in order to prevent slack in the protective coating of said publication and to evenly distribute forces exerted on said container, whereby said product sample is protected from damage.

2. The container of claim 1, wherein said recess does not extend completely through said core of said container.

3. The container of claim 1, wherein said recess extends completely through said core of said container.

4. The container of claim 1, wherein said backing is relatively less compressible than said core.

5. The container of claim 1, wherein said backing is relatively rigid in order to provide additional protection to said product sample.

6. The container of claim 1, wherein the shape of said recess conforms closely to the shape of said product sample in order to reduce the movement of said sample within said recess.

7. The container of claim 1, further comprising plural recesses, each of said recesses containing a single product sample, wherein no two recesses are separated by less than about ½ to 1 inch.

8. The container of claim 1, wherein the thickness of said container is not less than about ¼ inch in order to completely contain said product sample.

9. A method for producing a protective container for the distribution of a product sample to consumers, comprising:

(a) mounting said product sample in said protective container;

(b) coating said protective container with a transparent protective coating so that said product sample is visible therethrough and retained in said protective container;

(c) placing said protective container so that it engages a publication for distribution to a consumer; and (d) coating the combination of said publication and said protective container with a transparent protective coating so that the two are retained together for distribution to a consumer in a manner that permits said product sample to be readily visible to the consumer.

10. The method of claim 9, further comprising the step of positioning said product sample in a recess formed in said protective container.

* * * * *